United States Patent [19]

Yates

[11] 4,423,582

[45] Jan. 3, 1984

[54] GLASS DOOR AND WINDOW STRUCTURES

[75] Inventor: Leigh T. Yates, Lakewood, N.Y.

[73] Assignee: Falconer Glass Industries, Inc., Falconer, N.Y.

[21] Appl. No.: 285,343

[22] Filed: Jul. 20, 1981

[51] Int. Cl.[3] ..... E04C 2/38

[52] U.S. Cl. ..... 52/825; 52/766

[58] Field of Search ..... 52/764, 766, 767, 775, 52/821, 822, 823, 824, 825, 826

[56] References Cited

U.S. PATENT DOCUMENTS

| | | | |
|---|---|---|---|
| 1,919,311 | 7/1933 | Triller | 52/775 |
| 2,169,713 | 8/1939 | Stroud | 52/766 |
| 2,633,946 | 4/1953 | Huizenga | 52/826 |
| 2,759,574 | 8/1956 | Miller | 52/826 |
| 2,934,800 | 5/1960 | Hasbrouck et al. | 52/775 |
| 2,983,001 | 5/1961 | Guldager | 52/823 |
| 3,121,261 | 2/1964 | Ritter, Jr. | 52/764 |
| 3,190,408 | 6/1965 | Petterson | 52/766 |
| 4,064,924 | 12/1977 | Catlett | 52/775 |

*Primary Examiner*—Peter M. Caun

*Attorney, Agent, or Firm*—Buell, Blenko, Ziesenheim & Beck

[57] ABSTRACT

A glass door and window structure is provided in which a glass is placed in a groove in a metal frame having one straight and one sloping side with the glass spaced from the sloping side and an elongate metal shoe having a corresponding sloping side is placed between the glass and sloping side with the sloping sides in contact and means are provided for drawing the shoe into the groove to tightly and sealingly engage the glass.

5 Claims, 4 Drawing Figures

GLASS DOOR AND WINDOW STRUCTURES

This invention relates to glass door and window structures and particularly to a new glazing system for such glass doors and windows.

Tempered glass doors and sidelights are used in many office and commercial buildings. They are generally installed in a metal frame using one of a variety of bonding agents. The installation of glass in such conventional frame arrangement requires costly set-ups and fixtures and considerable skill to properly set and bond the tempered glass in place.

The present invention eliminates the need for the costly set-ups and fixtures currently required and eliminates the need for bonding agents.

This invention provides a metal door frame having a glass receiving groove with one side parallel to the surface of the frame and the other side sloping slightly inwardly toward the bottom of the groove, an opposing groove whose bottom is spaced from and parallel to the bottom of the glass receiving groove, a glass sheet in said glass receiving groove bearing against the said one side and spaced from the other sloping side, an elongate shoe member fitted in the glass receiving groove between the glass and said other sloping side, said shoe having a flat face bearing on the glass surface and a sloping face bearing on the said other sloping side, and means engaging said shoe to draw the same into said glass receiving groove with tight engagement between the glass and said other sloping side. Preferably the shoe is extruded aluminum. The means engaging the shoe is preferably a plurality of spaced screws extending from said opposing groove and threadingly engaging openings in the shoe. The metal frame is preferably of extruded aluminum.

In the foregoing general statement certain objects, purposes and advantages of this invention have been set out. Other objects, purposes and advantages of this invention will be apparent from the following description and the accompanying drawings in which.

Figure 1:
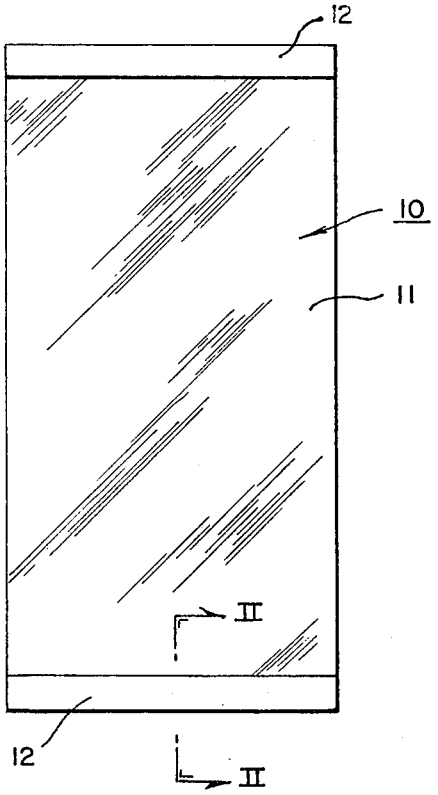
FIG. 1 is a side elevational view of a door according to this invention.
Figure 2:
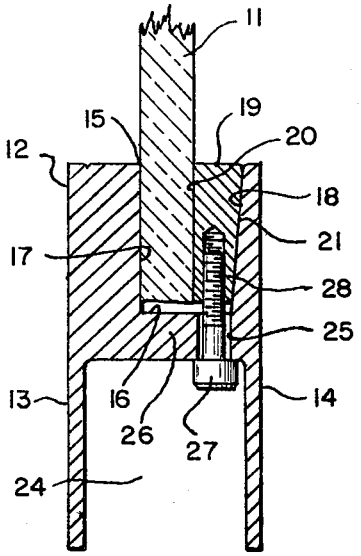
FIG. 2 is a fragmentary section on the line II—II of FIG. 1.
Figure 3:
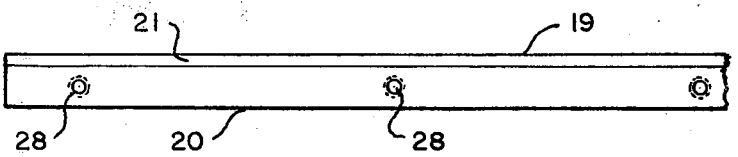
FIG. 3 is a bottom plan view of a shoe according to this invention.
Figure 4:
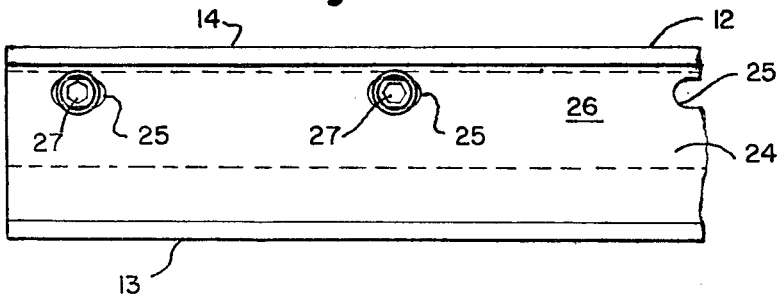
FIG. 4 is a fragmentary bottom plan view of the door of FIG. 1.

Referring to the drawings there is illustrated a door 10 having a tempered glass insert 11 surrounded by a metal frame 12. The metal frame 12 is preferably of extruded aluminum with two spaced parallel outer surfaces 13 and 14. A glass receiving groove 15 is provided having a bottom 16, one vertical side 17 parallel to outer surface 13 and an inwardly sloping side 18 spaced from side 17. The tempered glass insert 11 bears against side 17 on one side and the other side of the glass is spaced from sloping side 18. An elongate extruded aluminum shoe 19 having one side 20 bearing against the glass and an opposite sloping side 21 whose angle of slope is substantially the same as that of side 18 bearing against side 18. A second groove 24 is provided between surfaces 13 and 14, opposite glass receiving groove 15. A plurality of spaced passages 25 extends through the wall 26 between grooves 15 and 24 and beneath shoe 19. Socket head screw 27 pass through passages 25 and engage threaded openings 28 in the bottom of shoe 19. Screws 27 are tightened in opening 28 to draw shoe 19 into groove 15 wedging shoe 19 tightly and sealingly into engagement between the glass insert 11 and sloping side 18. This locks and seals the glass in the frame. The frame 12 could, of course, be made of a metal other than aluminum such as stainless steel, bronze or the like depending upon the architectural design.

In the foregoing specification certain preferred practices and embodiments of this invention have been set forth, however, it will be understood that this invention may be otherwise embodied within the scope of the following claims.

I claim:

1. A metal framed glass door and window structure comprising a metal frame having a glass receiving groove with one smooth side parallel to a face surface of said frame and an opposite smooth side sloping slightly inwardly toward a bottom of the groove, a glass sheet in said glass receiving groove bearing against the said one side and spaced from the said other sloping side, an elongate rigid metal shoe fitted in the glass receiving groove between the glass and said other sloping side, said shoe having a flat smooth face bearing on the glass surface and a sloping smooth face corresponding in slope to and bearing on the said opposite smooth sloping side of the frame and means in said frame engaging said shoe to draw it slidably relatively to and in direct contact with said glass and frame into said glass receiving groove generally parallel to the glass sheet in tight sealing engagement between the glass and said other sloping side to engage the glass in non-resilient engagement between the metal sidewall of the glass receiving groove and said metal shoe whereby said glass, frame and shoe form a single non-yielding structural entity.

2. A metal framed glass door and window structure comprising a metal frame having a glass receiving groove with one smooth side parallel to a face surface of said frame and an opposite smooth side sloping slightly inwardly toward a bottom of the groove, an opposing groove whose bottom is spaced from and generally parallel to the bottom of the glass receiving groove, a glass sheet in said glass receiving groove bearing against the said one side and spaced from the said other sloping side, an elongate rigid metal shoe member fitted in the glass receiving groove between the glass and said other sloping side, said shoe having a flat smooth face bearing on the glass surface and a sloping smooth facing corresponding in slope to and bearing on the said other sloping side of the frame and means engaging said shoe to draw the same slidably relatively to and in direct contact with said glass and frame into said glass receiving groove generally parallel to the glass sheet in tight sealing engagement between the glass and said other sloping side to engage the glass in non-resilient engagement between the metal sidewall of the glass receiving groove and said metal shoe whereby said glass, frame and shoe form a single non-yielding structural entity.

3. A metal frame glass door and window structure as claimed in claim 1 or 2 wherein the shoe is extruded aluminum.

4. A metal frame glass door and window structure as claimed in claim 1 or 2 or 3 wherein the frame is extruded aluminum.

5. A metal frame glass door and window structure as claimed in claim 1 or 2 or 3, or 4 wherein the means engaging the shoe is a plurality of spaced screws extending from said opposing groove and threadingly engaging openings in said shoe.

* * * * *